United States Patent [19]

Gutner

[11] 4,429,426

[45] Feb. 7, 1984

[54] BRACKET FOR SECURING A MATTRESS SUPPORTING MEMBER TO A BEDPOST

[76] Inventor: Kenneth H. Gutner, Highland Park, Ill. 60035

[21] Appl. No.: 310,880

[22] Filed: Oct. 13, 1981

[51] Int. Cl.[3] ..... A47C 19/00

[52] U.S. Cl. ..... 5/288; 5/296

[58] Field of Search ..... 5/296, 297, 304, 288, 5/303

[56] References Cited

U.S. PATENT DOCUMENTS

| | | | |
|---|---|---|---|
| 2,262,095 | 11/1941 | Butler | 5/296 |
| 2,627,616 | 2/1953 | Lasting | 5/296 |
| 3,226,736 | 1/1966 | Krieger | 5/296 |
| 4,068,332 | 1/1978 | Ball et al. | 5/296 |

FOREIGN PATENT DOCUMENTS

| | | | |
|---|---|---|---|
| 570616 | 2/1933 | Fed. Rep. of Germany | 5/296 |

*Primary Examiner*—Alexander Grosz
*Assistant Examiner*—Michael F. Trettel
*Attorney, Agent, or Firm*—Tilton, Fallon, Lungmus & Chestnut

[57] ABSTRACT

A bracket for securing a mattress-supporting member to a bedpost board which includes a generally rectangular unitary metal element having a central planar portion and integral return bend flanges along two sides, one of which is adapted to be received within the slot of a bed headboard normally used for receiving the hook means of a bed rail.

6 Claims, 7 Drawing Figures

FIG. 6
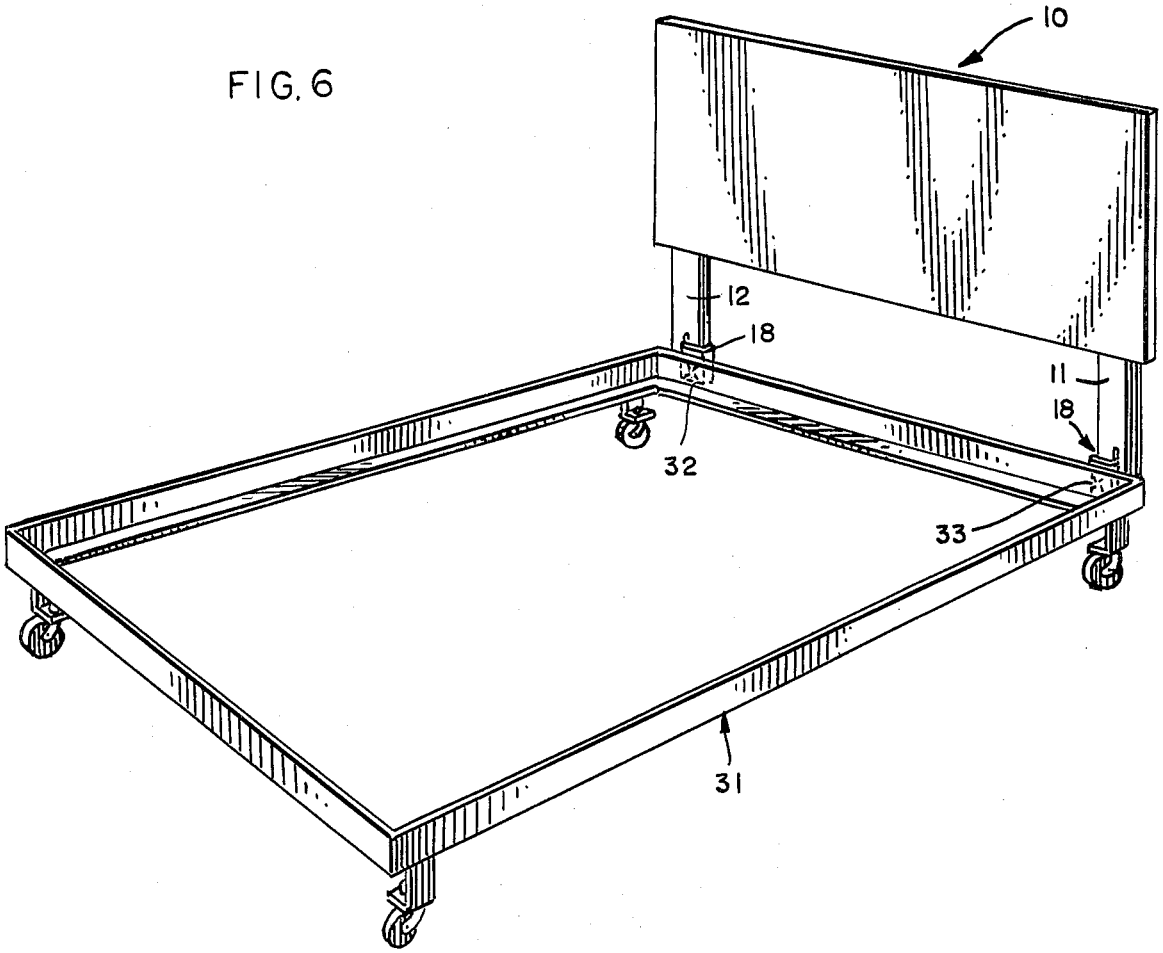
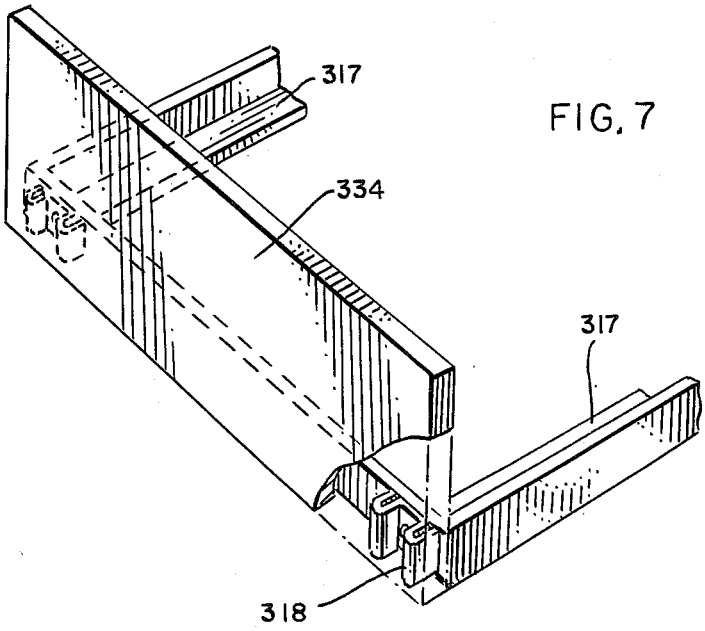
FIG. 7

BRACKET FOR SECURING A MATTRESS SUPPORTING MEMBER TO A BEDPOST

This invention relates to a bracket for securing a mattress-supporting member to a bedpost and, more particularly, to a versatile bracket which is suited for use either with a bed frame or a bed rail.

Endboards, i.e., headboards and footboards, have been used for the connecting means for the longitudinally extending bedrails. Increasingly, the rails are equipped with hooks at their ends—as for example in U.S. Pat. Nos. 3,171,140 and 3,349,414—for insertion into similarly contoured slots in the endboards. This has necessitated the use of rivets or pins in the bedposts to support the hooks with possible cracking or splintering of the bedposts. Attempts have been made to utilize brackets or blocks to avoid this difficulty, but without full success.

The instant invention avoids the difficulties experienced in the past and in addition provides a versatible bracket which also can accommodate the attachment of an endboard, particularly a headboard, to a rectangular frame for supporting the mattress and box-spring.

According to the invention, a unitary generally rectangular plate having a central planar portion is equipped with integral return bend flanges along two opposing sides along with means for securing the bracket to bedposts with one of the flanges mounted in a conforming slot—but without the pins of the unsuccessful prior art expedients. The walls defining the return bend flanges are advantageously integrated to support the hook means of a bed rail while the planar portion is equally advantageously slotted so as to accommodate attachment of a bed frame thereto.

Other objects and advantages of the invention may be seen in the details of the ensuing specification. The invention is described in conjunction with the accompanying drawing, in which FIG. 1 is a fragmentary perspective, exploded view of the invention as applied to a headboard;

FIG. 6 is a perspective view of an installation showing a bed frame connected to a headboard; and FIG. 7 is a fragmentary view showing the connection of a bed rail with the inventive bracket to a footboard.

DETAILED DESCRIPTION

Figure 1:
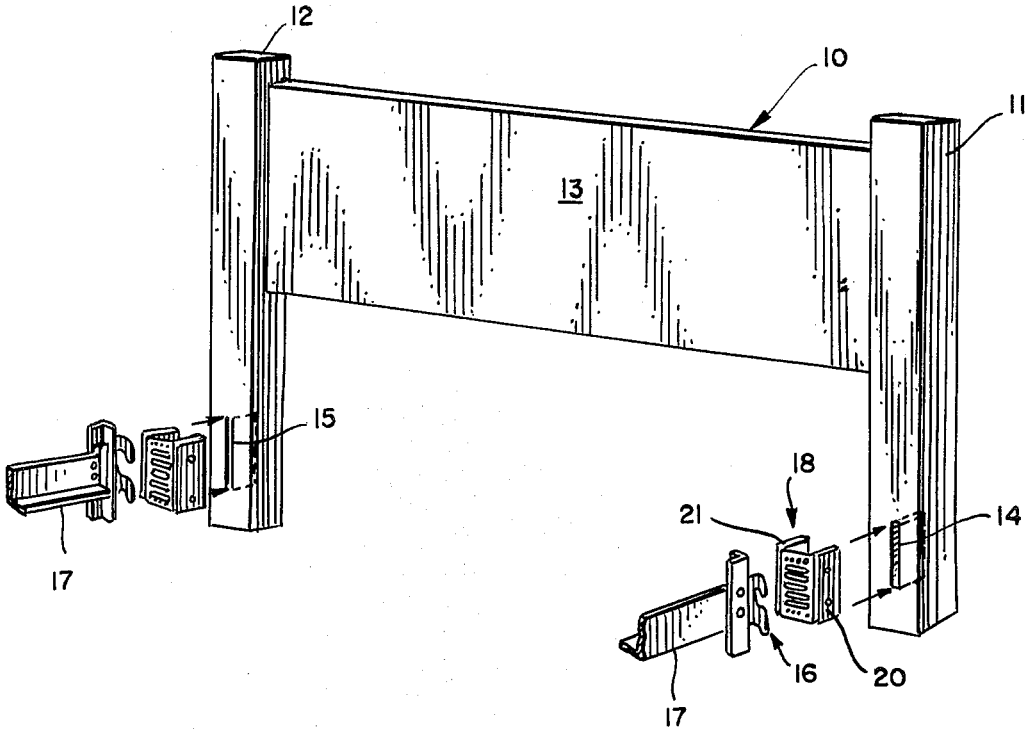

In the illustration given and with reference first to FIG. 1, the numeral 10 designates generally a bed headboard consisting of posts 11 and 12 and cross member 13 suitably secured therebetween. It will be appreciated that headboards come in a variety of styles but in all cases have vertical members extending down toward the floor and which are normally equipped with vertically elongated slots as at 14 and 15. In the past, these are the slots that were equipped with the horizontally extending pins for supporting the hook means generally designated 16 of the bed rails 17. The bed rails 17 are normally horizontally elongated angle irons so as to support the box-spring and mattress of the bed.

Figure 2:
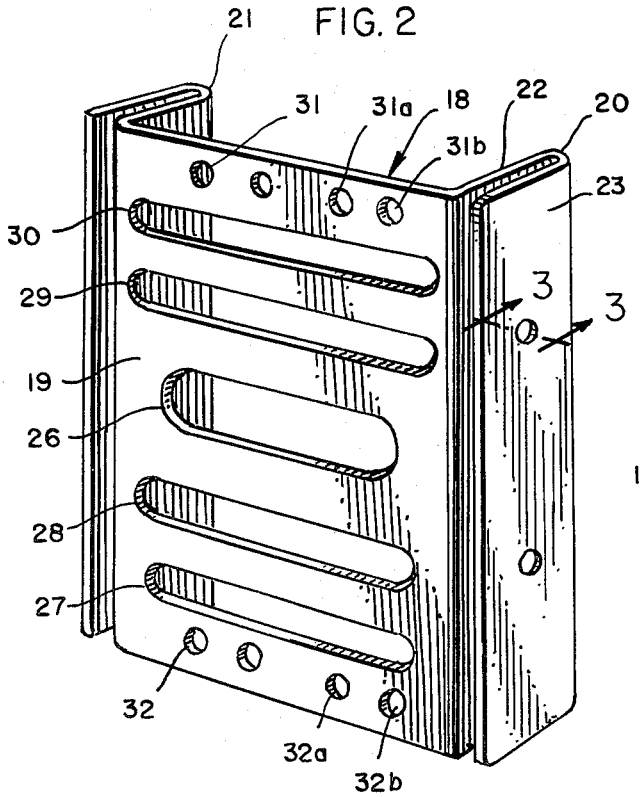
FIG. 2 is an enlarged perspective view of one form of the inventive bracket.

The inventive bracket is generally designated 18 and can be seen in larger scale in FIG. 2. Turning now to FIG. 2, the numeral 19 designates a central planar portion of the bracket and is seen to be equipped with integral return bend flanges along two sides as at 20 and 21. More particularly, each flange such as that designated 20 is defined by spaced apart parallel walls 22 and 23 which extend generally perpendicularly to the central planar portion 19. The slots 14 and 15 are contoured for the slidable receipt of the flanges 20 or 21, as the case may be. It will be appreciated that mattresses and box-springs come in varying widths as well as do the headboards so that the brackets can be installed so as to adjust to these differing widths, i.e., regular size, queen size, king size, etc.

Figure 3:
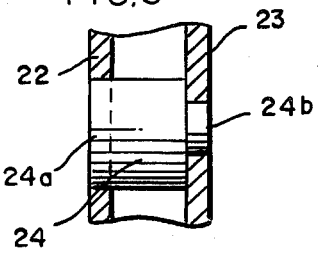
FIG. 3 is an enlarged sectional view taken along the sight line 3—3 of FIG. 2.

To provide supporting means for the hook means 16, the walls 22 and 23 are integrated by a rivet or post, advantageously of the form illustrated in FIG. 3. There, it is seen that a stepped cylinder 24 is installed between the two walls 22 and 23.

More particularly, the cylindrical post 24 has a larger diameter as at **24*a* and a smaller diameter as at 24*b* and the walls 22 and 23 are equipped with apertures or bores differently diametered so as to accommodate the different diameters of the cylinder 24. The ends of the cylinder 24 are integrated to the walls 22 and 23 by suitable swaging, crimping, etc. Thus, I provide a hook supporting means which is advantageously flush with the exterior of the flange 20 and facilitates installation within the slots 14 or 15**.

Figure 4:
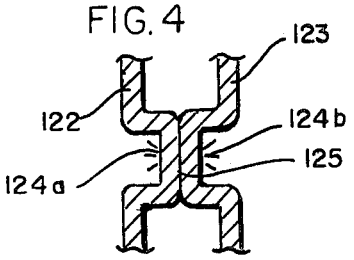
FIGS. 4 and 5 are views similar to FIG. 3 but of different embodiments of the invention.
Figure 5:
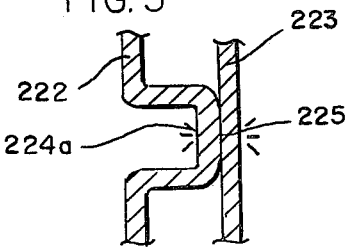

Alternative embodiments of the invention can be seen in FIGS. 4 and 5. In FIG. 4, for example, the wall 123 is seen to be inwardly deformed as at **124*b* while the wall 122 is inwardly deformed as at 124*a*. The deformation or indentations 124*a* and 124*b* are then weldably united as at 125** so as to provide a hook supporting means.

In FIG. 5, the wall 223 is undeformed while the wall 222 is deformed toward the wall 223 as at **224*a* and weldably united thereto as at 225**.

Returning to FIG. 2, a central slot 26 is provided in the planar portion for shipping purposes. Additionally I provide a plurality of elongated slots as at 27, 28, 29 and 30 to accommodate attachment—as by bolts—of a bed frame to headboard, for example. This can be seen by reference to FIG. 6.

In FIG. 6, the headboard is again generally designated by the numeral 10 and is equipped with posts 11 and 12 to which the brackets 18 are secured as just described. The numeral 31 designates generally a caster-equipped frame of rectangular construction which is secured at one end as by bolts 32 and 33 to the brackets 18 associated with the posts 12 and 11, respectively.

Returning to FIG. 2, there is seen a plurality of screw receiving openings 31 and 32. These are employed to secure the bracket 18 to the bedpost 11 or 12. As illustrated in FIG. 1, the bracket 18 would overlap the inside of the post, i.e., the flange 20 would enter the slot 14 while the flange 21 is inboard of the post 11. For securement, the screws (not shown) would extend through the openings **31*a*, 31*b*, 32*a*, 32*b*. The left hand screw openings would be used on the bracket 18 for the left bedpost 15**. With wider bedposts, a pair of slots is provided.

In FIG. 7, a slightly modified form of bracket is illustrated and designated by the numeral 318. This bracket differs essentially from the bracket 18 of FIG. 2 in being of lesser vertical extent by the elimination of the horizontal slots 27–30. Normally, a footboard is not used in conjunction with a frame so these are unneeded. However, the footboard 334 is seen to be used in conjunction with the side rails 317 in a manner analagous to that described hereinbefore relative to FIG. 1.

While in the foregoing specification a detailed description of an embodiment of the invention has been set down for the purpose of illustration, many variations in the details hereingiven may be made by those skilled in the art without departing from the spirit and scope of the invention.

I claim:

1. A bracket for securing a mattress-supporting member to a bedpost comprising a generally rectangular unitary metal element having a central planar portion and an integral return-bend flange along two opposing sides, each of said flanges projecting perpendicularly away from said central planar portion and providing spaced apart walls adapted to receive the hook means of a bedrail, a pair of spaced apart hook supporting means connecting said walls of each flange and integrated therewith to facilitate insertion of either of said flanges into an elongated slot of a bedpost and means in said central planar portion for securing said bracket to a bed end board.

2. The structure of claim 1 in which said central planar portion is equipped with a plurality of elongated slots extending between said flanges for the securement of a bed rail to a bed frame.

3. The structure of claim 1 in which said supporting means is a cylinder stepped at one end, said walls being differently apertured to receive the diameters of said stepped cylinder.

4. The structure of claim 1 in which said supporting means includes a deformed wall portion weldably united to the opposing wall.

5. The structure of claim 4 in which both walls are deformed toward each other and weldably united.

6. A bracket for securing either a bed rail or a bed frame to a bedpost comprising a generally rectangular unitary metal element having a flat central portion adapted to extend vertically when installed in the bed headboard, said headboard being equipped with horizontally spaced slots for the receipt of bedrail hook means, said element being equipped with horizontally spaced apart vertically extending flanges, each flange being adapted to be inserted within a bedpost slot and including a return bend fold defined by spaced apart walls, rivet means connecting the walls of each flange together to support the hook means of a bedrail, said central planar portion being equipped with horizontally elongated slots between said flanges for the boltable attachment to said bracket of a bed frame, and means on said bracket for securing said bracket to said bedpost independent of said flanges.

* * * * *